US005323740A

United States Patent [19]

Daily et al.

[11] Patent Number: 5,323,740

[45] Date of Patent: Jun. 28, 1994

[54] MOLDED DUAL CAM COVER

[75] Inventors: Robert A. Daily, Waterford, Mich.; Eduardo J. Jimenez, Colorado Springs, Colo.

[73] Assignee: Saturn Corporation, Troy, Mich.

[21] Appl. No.: 91,070

[22] Filed: Jul. 13, 1993

[51] Int. Cl.[5] ..... F01M 9/10

[52] U.S. Cl. ..... 123/90.38; 123/41.86; 123/143 C; 123/195 C; 123/572

[58] Field of Search ..... 123/90.37, 90.38, 41.86, 123/195 C, 198 E, 572, 143 C

[56] References Cited

U.S. PATENT DOCUMENTS

| | | | |
|---|---|---|---|
| 4,498,433 | 2/1985 | Ogawa | 123/90.38 |
| 4,538,560 | 9/1985 | Alden | 123/195 C |
| 4,721,090 | 1/1988 | Kato | 123/572 |
| 4,727,833 | 3/1988 | Nakashima | 123/195 C |
| 4,756,283 | 7/1988 | Kleinböhl | 123/143 C |
| 4,821,699 | 4/1989 | Mackin | 123/90.38 |
| 4,993,375 | 2/1991 | Akihiko | 123/90.38 |
| 5,058,542 | 10/1991 | Grayson et al. | 123/41.86 |
| 5,129,371 | 7/1992 | Rosalik, Jr. | 123/90.38 |
| 5,168,842 | 12/1992 | Brooks | 123/143 C |
| 5,228,420 | 7/1993 | Furuya et al. | 123/90.38 |
| 5,255,647 | 10/1993 | Kiczek | 123/195 C |

*Primary Examiner*—E. Rollins Cross
*Assistant Examiner*—Weilun Lo
*Attorney, Agent, or Firm*—Robert J. Outland

[57] ABSTRACT

A dual cam cover has a molded housing made, preferably, of a thermoset polyester composite material replacing an aluminum casting. An integral stiffening bar added between raised cam chamber walls includes retaining slots for holding associated spark plug wires. Peripheral mounting bosses include cylinder like angled ribs for sturdy support with a pleasant appearance. Isolated mounting screws combine with resilient gaskets in the peripheral flange and around central spark plug and fastener openings to provide sealing and mounting isolation. Improved oil separators include one piece metal baffles with formed drain openings. A bushing and a threaded insert are molded in for mounting a vent tube and an accessory.

9 Claims, 3 Drawing Sheets

MOLDED DUAL CAM COVER

TECHNICAL FIELD

This invention relates to cam covers for engines, especially of the dual overhead cam type.

BACKGROUND

It is known in the art relating to dual overhead cam engines to provide a cam cover defining a pair of laterally spaced cam chambers connected by a valley panel through which openings for spark plugs and fastening screws are provided. In a prior commercial cam cover embodiments, described in part in U.S. Pat. No. 5,129,371 assigned to the assignee of the present invention, an aluminum cover was provided with a peripheral flange and bosses for mounting screws, not described. Oil separation means were provided in the upper portions of the cam chambers.

SUMMARY OF THE INVENTION

The present invention relates to cam covers similar to those described in U.S. Pat. No. 5,129,371 but having various novel features that provide improved or modified functions or advantages.

Instead of aluminum or other metal, the cover housing is formed of a molded composite, preferably a thermoset polyester material equivalent to "CYGLAS 685" (a trademark or trade name) obtainable from the American Cyanamid Company. A stiffening bar added opposite the cam drive end of the cover to reduce flexing incorporates shaped slots for spacedly retaining spark plug wires leading from the plug openings out the end of the valley. Angled cylinder like stiffening ribs connect the mounting bosses with the adjacent walls in a sturdy as well as ornamental manner. Molded in inserts include a hex shaped threaded mount for an accessory and a bushing for mounting a sleeve in the crankcase ventilation system. Baffles for the oil separators include floor and shelf portions formed from a single folded sheet.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
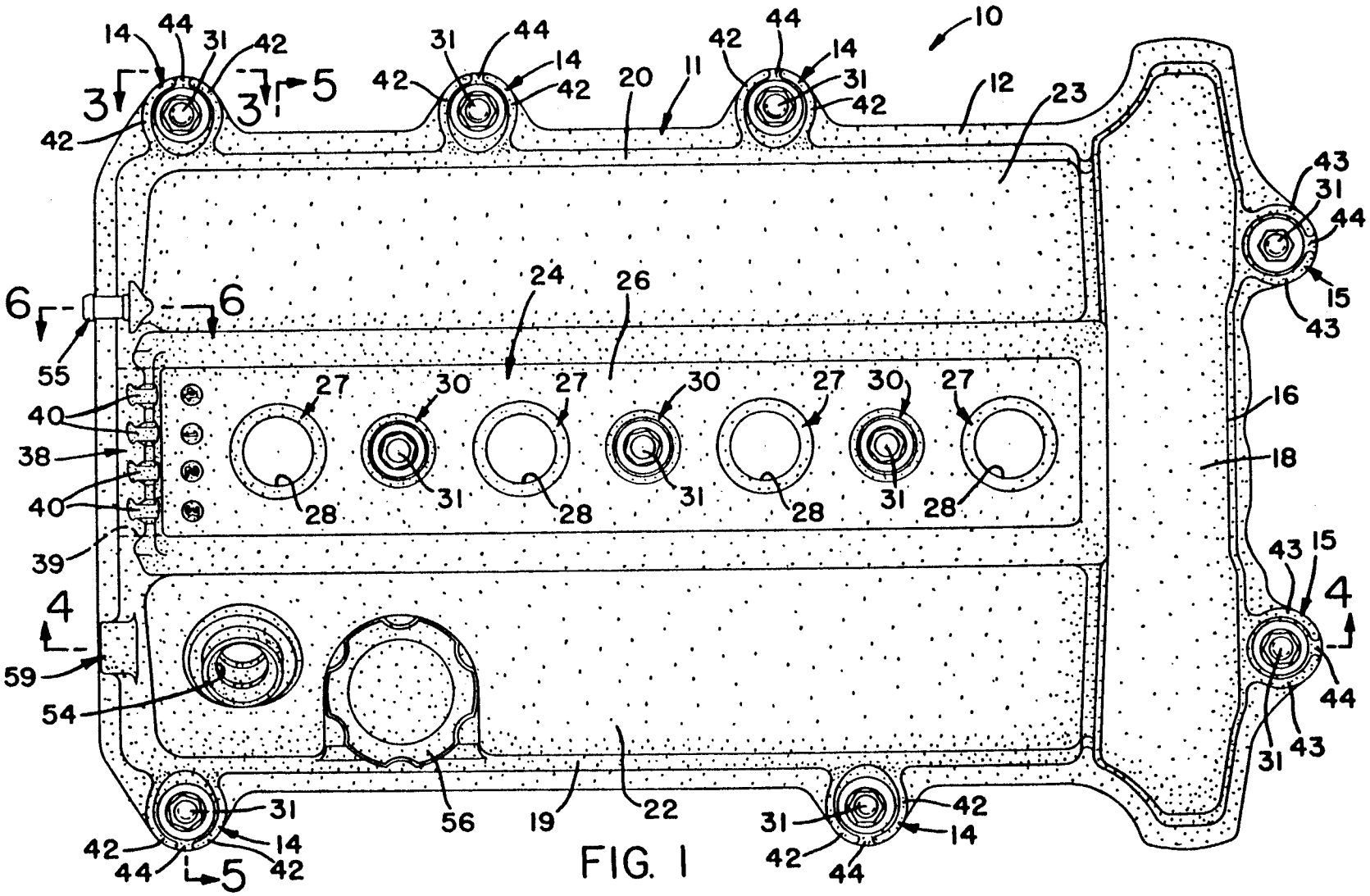
FIG. 1 is a plan view of a dual cam valve cover according to the invention.
Figure 3:
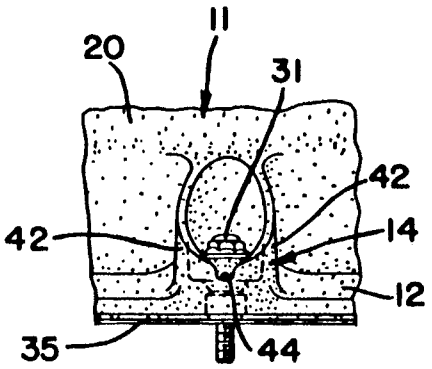
FIG. 3 is a fragmentary side view from the line 3—3 of FIG. 1 showing one of the stiffened bosses.
Figure 2:
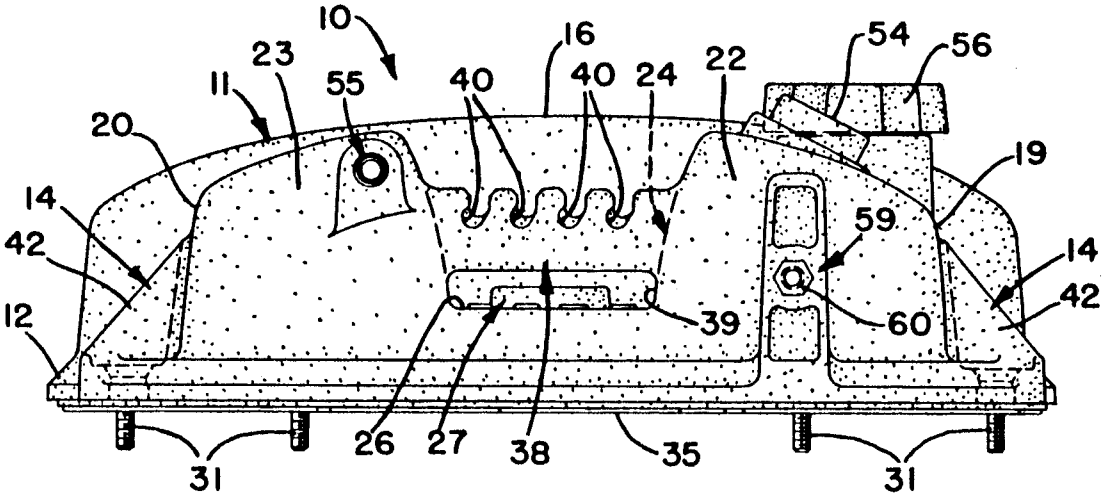
FIG. 2 is a rear end view of the cover of FIG. 1.
Figure 4:
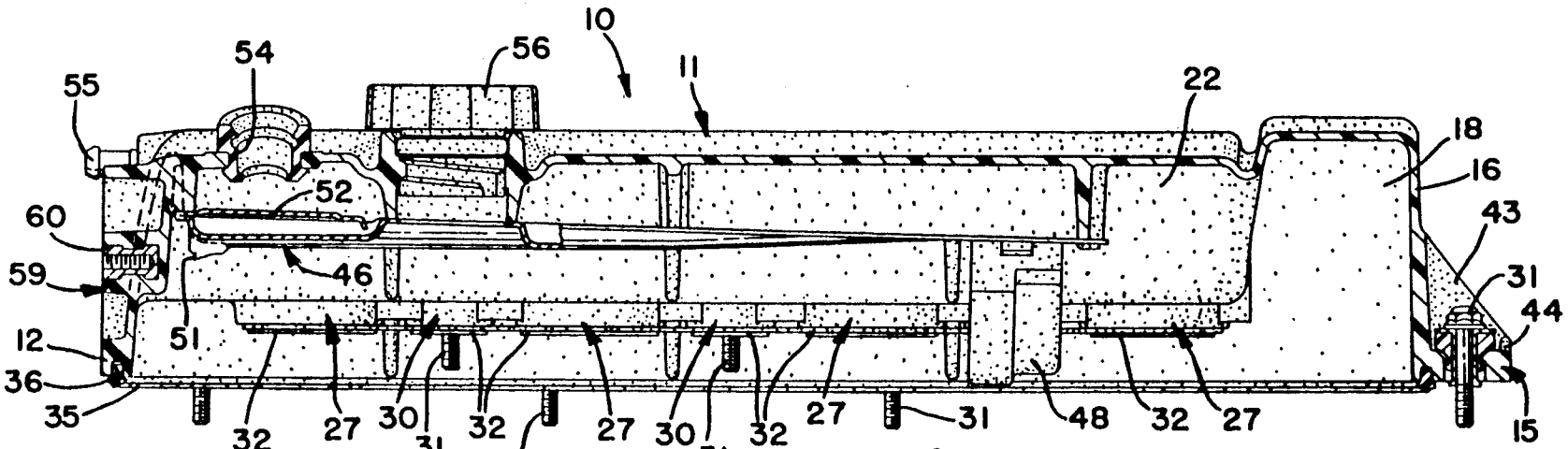
FIG. 4 is a longitudinal cross-sectional view from the line 4—4 of FIG. 1.
Figure 5:
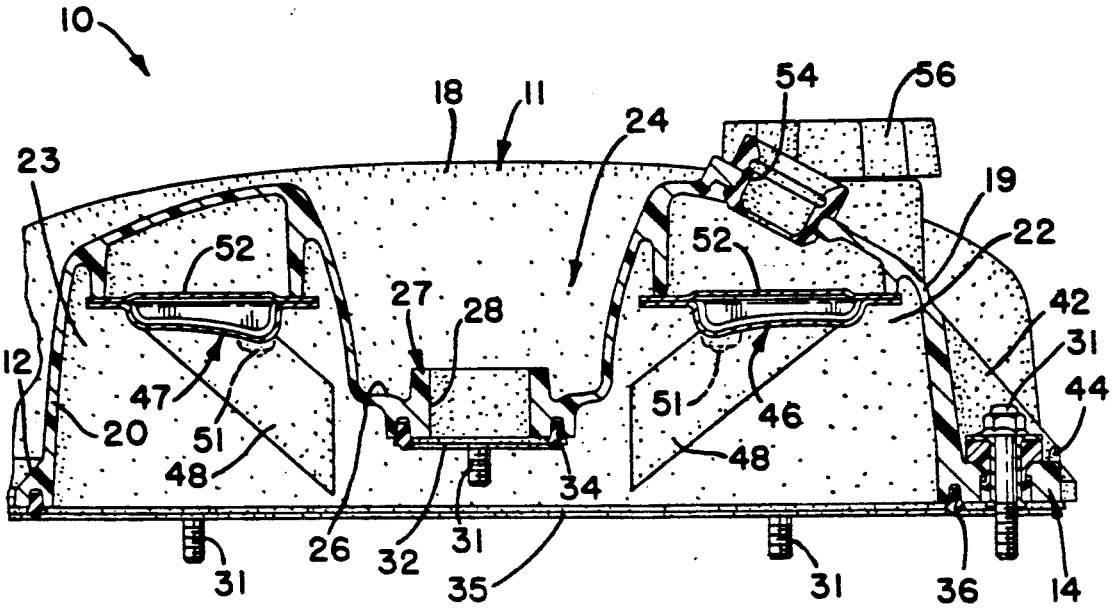
FIG. 5 is a transverse cross-sectional view from the line 5—5 of FIG. 1.

Referring now to the drawings in detail, numeral 10 generally indicates a preferred embodiment of a cam cover for a four cylinder spark ignition dual overhead cam internal combustion engine. The cam cover 10 includes a housing 11 which is preferably molded from a plastic material. A preferred material is a thermoset polyester composite equivalent to "CYGLAS 685" obtainable from the American Cyanimid Company.

The cam cover housing 11 includes a peripheral sealing flange 12 having side and front end mounting bosses 14, 15 spaced therealong. The end bosses 15 connect with upwardly extending walls 16 defining a transverse drive chamber 18 for the camshaft chain drive, not shown. The side bosses 14 connect with upwardly extending walls 19, 20 that define separate cam chambers 22, 23 extending longitudinally from the front end drive chamber to the portion of flange 12 at the rear end of the cover.

Between the cam chambers, a valley 24 is formed having a generally horizontal lower wall designated a valley panel 26. Panel 26 includes four longitudinally spaced bosses 27 defining spark plug openings 28. Between these openings are alternately spaced three additional mounting bosses 30. In each of the mounting bosses 30, 15, 14 are openings in which are received resilient grommet isolated mounting screws 31. These are used to secure the cover at the valley, the sides and the front end to an associated cylinder head or cam carrier of an associated engine (not shown).

A rubber-like seal 32 is received in grooves 34 surrounding the spark plug bosses 27 and fastener bosses 30 on the lower side of the valley panel. A similar peripheral seal 35 lies in a groove 36 in the lower edge of the flange 12 around the outside of the housing 11. The seals 32, 35 combine with the grommets of the screws 31 under controlled compression to seal the cover against oil leakage while also providing noise reducing vibration isolation of the cover from the engine.

At the rear end of the housing 11, the walls 19, 20 of the cam chambers 22, 23 are interconnected by a stiffening bar 38 extending laterally between them. The bar 38 increases the stiffness of the rear end of the housing by traversing the open valley 24 which, at the front end, is closed by the walls 16 of the drive chamber. The bar 38 is molded integrally with and of the composite housing material. An opening 39 under the bar 38 allows for the draining of liquids from the valley out the cover end. Along the top of the bar are four laterally spaced longitudinal slots 40. The slots are shaped with rounded bases and slightly narrowed upper portions to clampingly retain individual spark plug wires (not shown) associated with the spark plugs installed through the spark plug openings 28 in the valley panel 26. The slots may be curved to one side at their outer ends as shown to direct the wires smoothly toward a selected side of the cover. Numerals 1–4 may be molded on to the valley panel 26 adjacent the slots 40 to indicate the proper locations for the spark plug wires.

The side and end mounting bosses 14, 15 are stiffened for improved performance of the thermoset composite plastic material by the addition of cylinder like stiffening ribs 42, 43. These ribs are molded onto the adjacent chamber walls 19, 20 and 16, respectively, and are angled downward toward the bosses to form oval appearing openings, as viewed from the side, terminating in small drain notches 44 at the outer edges of the bosses. Because of the slope of the cam chamber walls, the associated ribs 42 have a slightly oval shape as viewed from above while the ribs 43 are more round. These angled cylindrical ribs not only provide sturdy support for the bosses 14, 15 but also give the bosses a particularly pleasing appearance.

Figure 6:
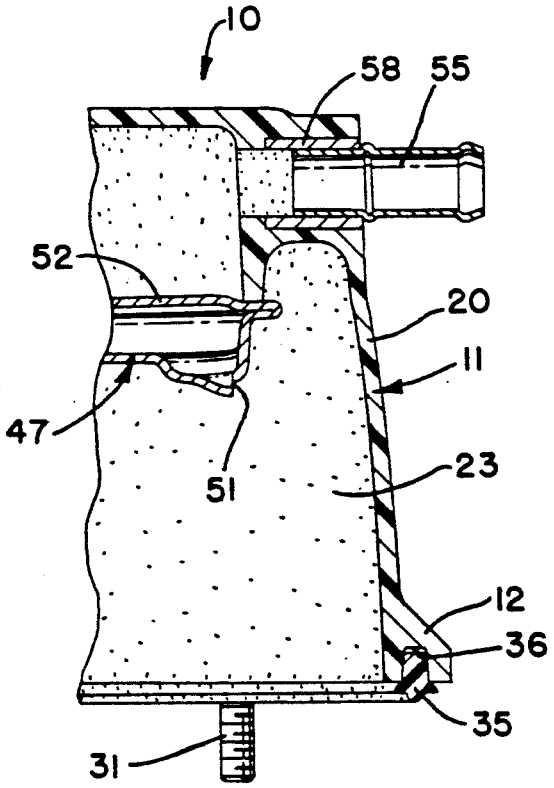
FIG. 6 is a fragmentary cross-sectional view from the line 6—6 of FIG. 1.

Within the upper portions of the cam chambers 23, 24 oil separation means are provided which are somewhat similar to those illustrated in FIGS. 6–9 of the aforementioned U.S. Pat. No. 5,129,371. However, the ribs of the previous design have been deleted from the separation chambers. Formed metal oil separator baffles 46, 47 mount depending inlet tubes 48. As before, the inlet tubes may be nonmetallic and snap into openings in the metal baffles. But the baffles are made more cost and performance effective by forming a sheared drain opening 51 during the stamping operation and making each baffle from a single metal blank. This is done by stamping the metal blank to its nearly final form including the drain opening 51 and then folding the end portion over the top to form a shelf 52 above the drain opening portion. Since the drain 51 opens to the rear, it reduces the potential for oil entry by upward splash. Above the shelves 52, the separation chambers connect as before with either a grommeted opening 54 for receiving a PCV crankcase ventilation valve or with a nipple or tube 55 for connection with an air/crankcase vapor hose. An oil fill cap 56 is provided for closing an oil filler opening as before.

To mount the tube 55 in the molded composite housing, a bushing 58 is molded into the rear end of the housing in a passage connecting with the oil separation chamber in cam chamber 23. This simplifies molding of the housing and allows the tube 55 to be pressed into the bushing 58 after molding. A boss 59 on the rear end of the other chamber wall 19 is provided with a accessory mount comprising a threaded insert 60 having hex ends with a reduced cylindrical center to lock the insert in place.

While the invention has been described by reference to certain preferred features and embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine cam cover for an engine having dual overhead camshafts, the cam cover having a housing including a peripheral sealing flange having mounting bosses spaced therealong, walls defining a pair of laterally spaced longitudinally extending cam chambers separated by a valley and positioned above and inward of the flange, a valley panel generally parallel with the flange and connecting the chamber defining walls laterally between lower portions of the chambers, the panel having spaced openings for spark plug wires, transverse wall means laterally interconnecting the chamber defining walls at one end of the cover, an oil separator baffle fixed within at least one of the chambers, said baffle including a longitudinal floor having a cover-like shelf at one end, oil drain means in the floor below the shelf, opening means through one of the chamber defining walls and connecting with at least one of the chambers above the shelf for fluid exchange with the chamber without disturbing oil collected below the shelf, wherein the cam cover housing is formed of a molded plastic and includes a stiffening bar vertically and transversely interconnecting the chamber defining walls at an opposite end of the cover from said one end, spaced slot means formed along an upper edge of the stiffening bar and sized to clampingly retain the spark plug wires extending from the valley panel openings, the flange mounting bosses are supported by cylinder like stiffening ribs connecting the bosses with adjacent portions of the chamber defining walls, the ribs being outwardly angled to form oval appearing openings, a bushing is molded into a chamber defining wall above the baffle shelf for receiving a pressed in tube connection fitting in a solid non-loosening mounting, and the baffle shelf is formed with the floor from a single blank of sheet material, the shelf being folded over the floor to create the fluid separating shelf.

2. The invention as in claim 1 wherein the wire retaining slots are longitudinally angled to direct the spark plug wires toward one lateral side of the cam cover.

3. The invention as in claim 2 wherein the slots are curved to direct the wires toward said one side of the cover.

4. The invention as in claim 1 wherein the housing is molded from a thermoset polyester material.

5. The invention as in claim 4 wherein the material is equivalent to CYGLAS 685.

6. The invention as in claim 1 wherein the baffle is made of sheet steel.

7. The invention as in claim 1 wherein the housing includes a boss having a molded in threaded insert for mounting an accessory, the insert having enlarged ends and a smaller center for retention in the housing.

8. The invention as in claim 1 wherein the oil drain means includes a drain opening made by shearing of the sheet material during forming of the baffle.

9. The invention as in claim 8 wherein the drain opening faces laterally toward a wall of the chamber.

* * * * *